US005232347A

United States Patent [19]

VonBergen

[11] Patent Number: 5,232,347

[45] Date of Patent: Aug. 3, 1993

[54] FAN MOUNTING BRACKET APPARATUS

[76] Inventor: Howard J. VonBergen, 5920 Merlindale Dr., Citrus Heights, Calif. 94510

[21] Appl. No.: 879,906

[22] Filed: May 8, 1992

[51] Int. Cl.[5] ..... F04D 25/28

[52] U.S. Cl. ..... 416/244 R; 416/5; 416/146 R; 244/300

[58] Field of Search ..... 416/146 R, 5, 244 R; 244/300

[56] References Cited

U.S. PATENT DOCUMENTS

| | | | |
|---|---|---|---|
| 2,161,674 | 6/1939 | Heindl | 248/300 |
| 3,595,402 | 7/1971 | Smaczny | 248/300 |
| 3,730,472 | 5/1973 | Dale | 248/300 |
| 3,809,347 | 5/1974 | Pekarek | 248/48.1 |
| 4,341,151 | 7/1982 | Sakamoto | 416/247 R |
| 5,018,944 | 5/1991 | Bielecki et al. | 416/146 R |

FOREIGN PATENT DOCUMENTS

| | | | |
|---|---|---|---|
| 35092 | 2/1987 | Japan | 416/244 R |
| 251493 | 11/1987 | Japan | 416/244 R |
| 3612 | of 1890 | United Kingdom | 416/146 |

*Primary Examiner*—Edward K. Look
*Assistant Examiner*—Michael S. Lee
*Attorney, Agent, or Firm*—Leon Gilden

[57] ABSTRACT

A fan mounting bracket is arranged to permit selective vertical positioning of a ceiling fan relative to a vertical support wall. The bracket structure includes a horizontal plate orthogonally and fixedly mounted to a vertical plate permitting respective first and second strengthening ribs orthogonally intersecting to provide for minimizing vibrational translation from an associated ceiling fan mounted to the vertical plate. A modification of the invention includes cleaning structure pivotally mounted to the horizontal plate to permit selective cleaning of the fan blades in use.

4 Claims, 4 Drawing Sheets 6
11
12
14
20
21
22
23
24
25
26
27
28
29
30
31

FAN MOUNTING BRACKET APPARATUS

BACKGROUND OF THE INVENTION

1. Field of the Invention

The field of invention relates to ceiling fan apparatus, and more particularly pertains to a new and improved fan mounting bracket apparatus wherein the same is arranged for the selective positioning of a ceiling fan relative to a vertical wall surface.

2. Description of the Prior Art

Ceiling fans of various types are utilized throughout the prior art. Contemporary positioning of ceiling fans is typically mandated by available height of an associated ceiling. The instant invention attempts to overcome deficiencies of the prior art by providing for the selective positioning of a ceiling fan vertically relative to an existing ceiling regardless of existing ceiling height. Prior art mounting organizations for ceiling fans is exemplified in U.S. Pat. No. 4,729,725 to Markwardt indicating conventional mounting of a ceiling fan relative to an associated ceiling.

Further examples of ceiling fan mounting structure are U.S. Pat. Nos. 4,714,230; 4,684,092; 4,645,158; and 4,538,786.

Accordingly, it may be appreciated that there continues to be a need for a new and improved fan mounting bracket apparatus as set forth by the instant invention which addresses both the problems of ease of use as well as effectiveness in construction in the selective vertical orientation of a ceiling fan relative to a vertical support surface and in this respect, the present invention substantially fulfills this need.

SUMMARY OF THE INVENTION

In view of the foregoing disadvantages inherent in the known types of ceiling fan mounting structures now present in the prior art, the present invention provides a fan mounting bracket apparatus wherein the same is arranged to permit selective vertical positioning of a ceiling fan relative to an existing vertical support surface. As such, the general purpose of the present invention, which will be described subsequently in greater detail, is to provide a new and improved fan mounting bracket apparatus which has all the advantages of the prior art ceiling fan mounting structures and none of the disadvantages.

To attain this, the present invention provides a fan mounting bracket arranged to permit selective vertical positioning of a fan relative to a vertical support wall. The bracket structure includes a horizontal plate orthogonally and fixedly mounted to a vertical plate permitting respective first and second strengthening ribs orthogonally intersecting to provide for minimizing vibrational translation from an associated ceiling fan mounted to the vertical plate. A modification of the invention includes cleaning structure pivotally mounted to the horizontal plate to permit selective cleaning of the fan blades in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fan mounting bracket apparatus which has all the advantages of the prior art ceiling fan structures and none of the disadvantages.

It is another object of the present invention to provide a new and improved fan mounting bracket apparatus which may be easily and efficiently manufactured and marketed.

It is a further object of the present invention to provide a new and improved fan mounting bracket apparatus which is of a durable and reliable construction.

An even further object of the present invention is to provide a new and improved fan mounting bracket apparatus which is susceptible of a low cost of manufacture with regard to both materials and labor, and which accordingly is then susceptible of low prices of sale to the consuming public, thereby making such fan mounting bracket apparatus economically available to the buying public.

Still yet another object of the present invention is to provide a new and improved fan mounting bracket apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
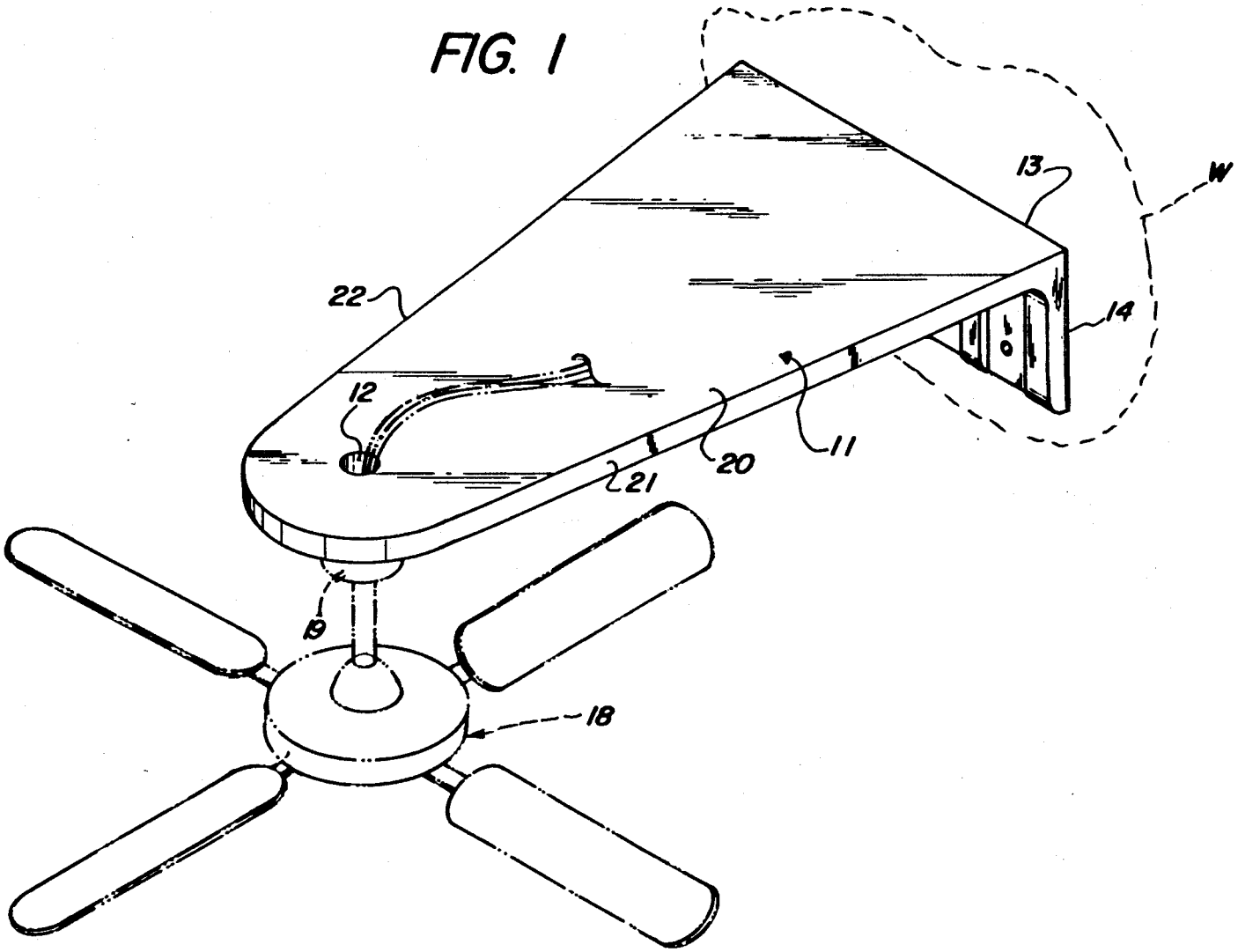
FIG. 1 is an isometric illustration of the instant invention.
Figure 3:
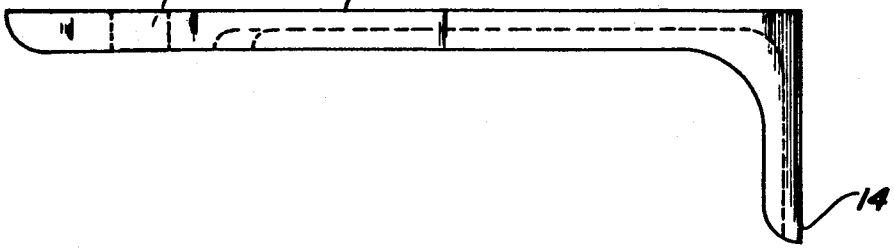
FIG. 3 is an orthographic side view of the invention.
Figure 4:
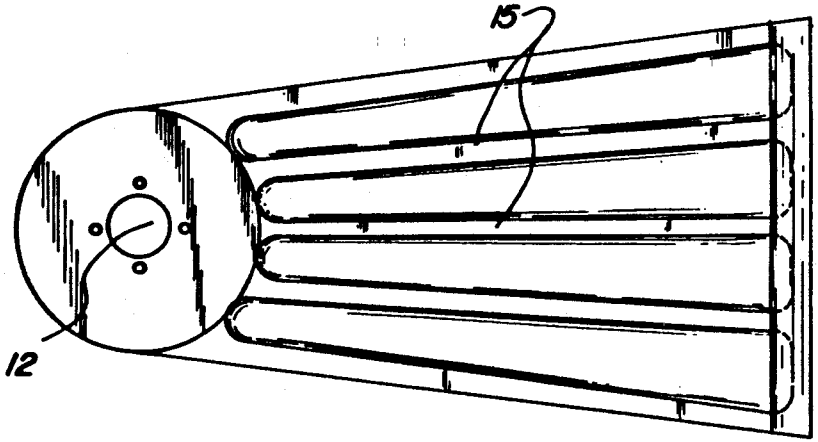
FIG. 4 is an orthographic bottom view of the invention.
Figure 2:
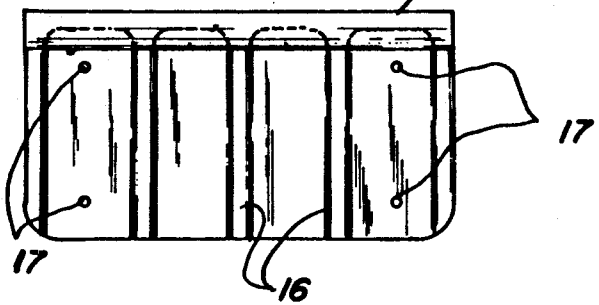
FIG. 2 is an orthographic frontal view of the invention.
Figures 5, 6:
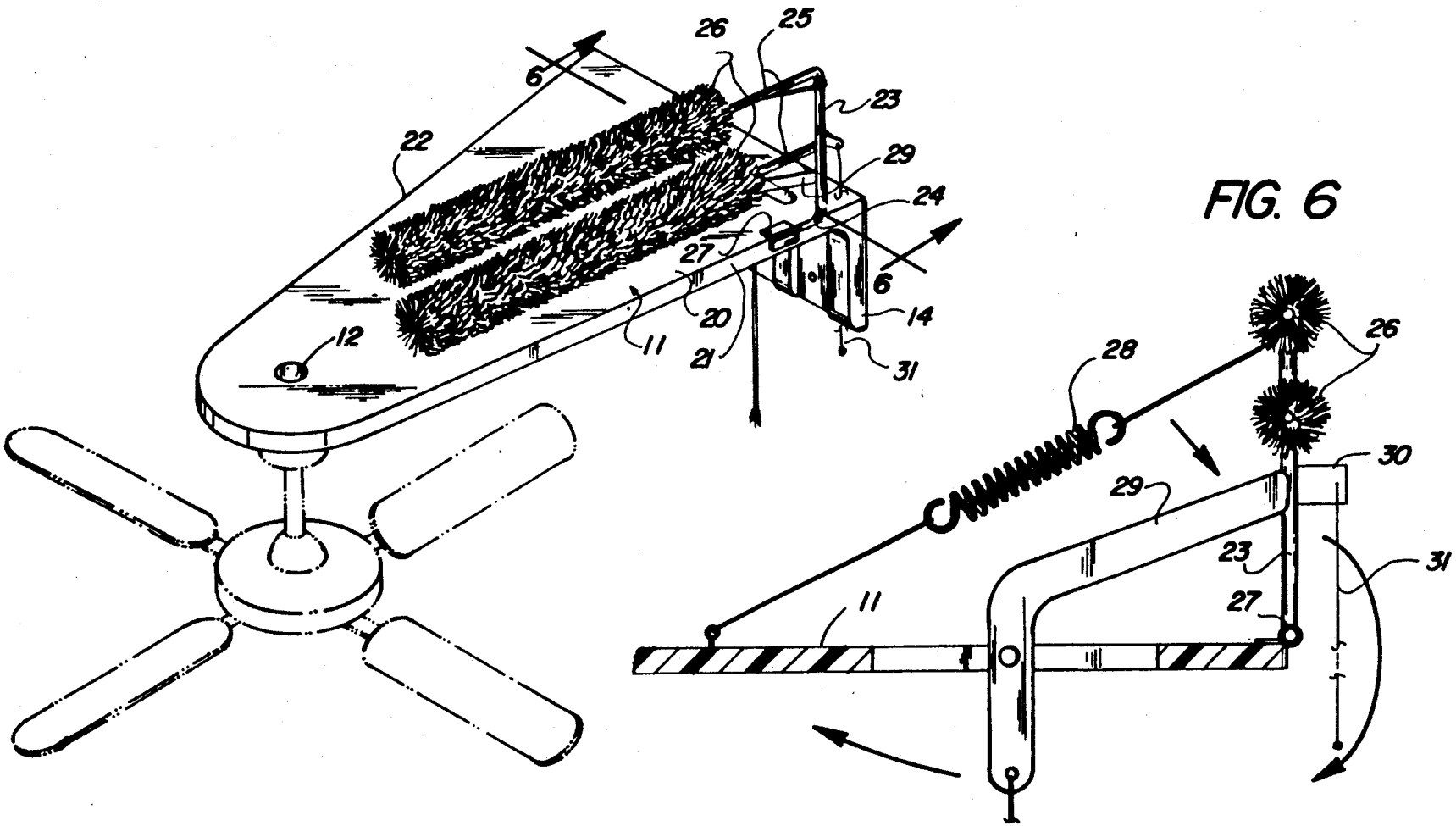
FIG. 5 is an isometric illustration of a modified aspect of the invention.
FIG. 6 is an orthographic view, taken along the lines 6—6 of FIG. 5 in the direction indicated by the arrows.
Figure 8:
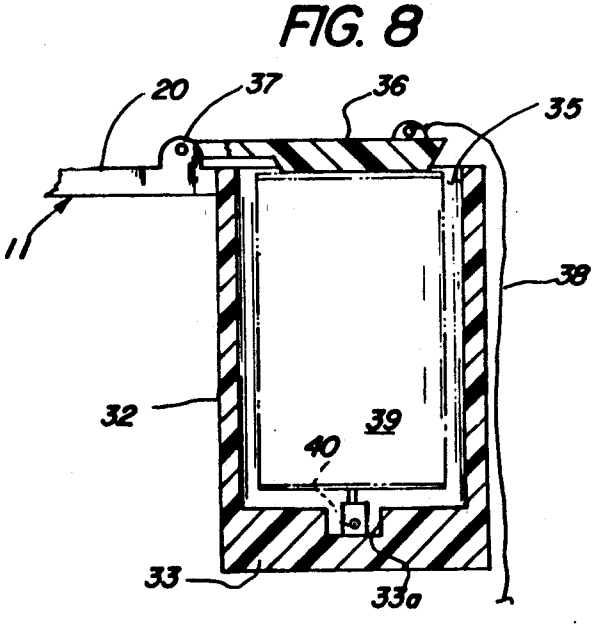
FIG. 8 is an orthographic view, taken along the lines 8—8 of FIG. 7 in the direction indicated by the arrows.

With reference now to the drawings, and in particular to FIGS. 1 to 8 thereof, a new and improved fan mounting bracket apparatus embodying the principles and concepts of the present invention will be described.

More specifically, the fan mounting bracket apparatus of the instant invention essentially comprises a horizontal mounting plate 11 fixedly and orthogonally mounted at a mounting plate rear edge 13 to a vertical mounting plate 14. The horizontal mounting plate 11 includes a plate bore 12 directed through the horizontal mounting plate 11 adjacent its forward edge spaced from the rear edge 13. The horizontal mounting plate 11 includes a plurality of spaced first ribs 15 orthogonally intersecting second spaced ribs 16 mounted and formed to the vertical mounting plate. The ribs permit strengthening of the organization as well as minimizing translation of vibration directed from an associated ceiling fan assembly 18. The ceiling fan assembly 18 in turn is mounted in coaxially aligned relationship relative to the plate bore 12, with the ceiling fan mounting base 19 secured to the horizontal mounting plate 11 coaxially aligned with the plate bore 12 below the horizontal mounting plate's top surface 20. The vertical mounting plate includes mounting apertures 17 to permit securement of the vertical mounting plate and the associated bracket assembly relative to a vertical wall support surface "W".

The horizontal mounting plate includes respective first and second sides 21 and 22, with the first side 21 including a support post 23 having a support post lower leg 24 orthogonally mounted to a lower distal end of the support post 23, with a support post lower leg 24 rotatably mounted within a lower leg hinge tube 27 positioned in alignment along the first side 21. A plurality of support post top legs 25 spaced above and in a parallel relationship relative to the lower end 24 are fixedly mounted to the support post 23, with each of the top legs 25 mounting a roller brush 26. A tension spring 28 secured between the top surface and the support post 23 biases the support posts in a raised orientation for engagement of a forward end of an abutment bar 29 extending from the top surface 20. An actuator support bar 30 extending forwardly and orthogonally relative to the support post 23 above the lower leg 27 includes an actuator cord 31 mounted thereto. Upon manual tensioning of the actuator cord 31, the support post 23 is pivoted downwardly to permit engagement of the brushes 26 with the blades of the ceiling fan to permit selective cleaning of the top surface of the ceiling fan blades. Accordingly, the brushes are positioned in an area to engage the top surfaces of the ceiling fan blades and are of sufficient length to accomplish such purpose.

Figure 7:
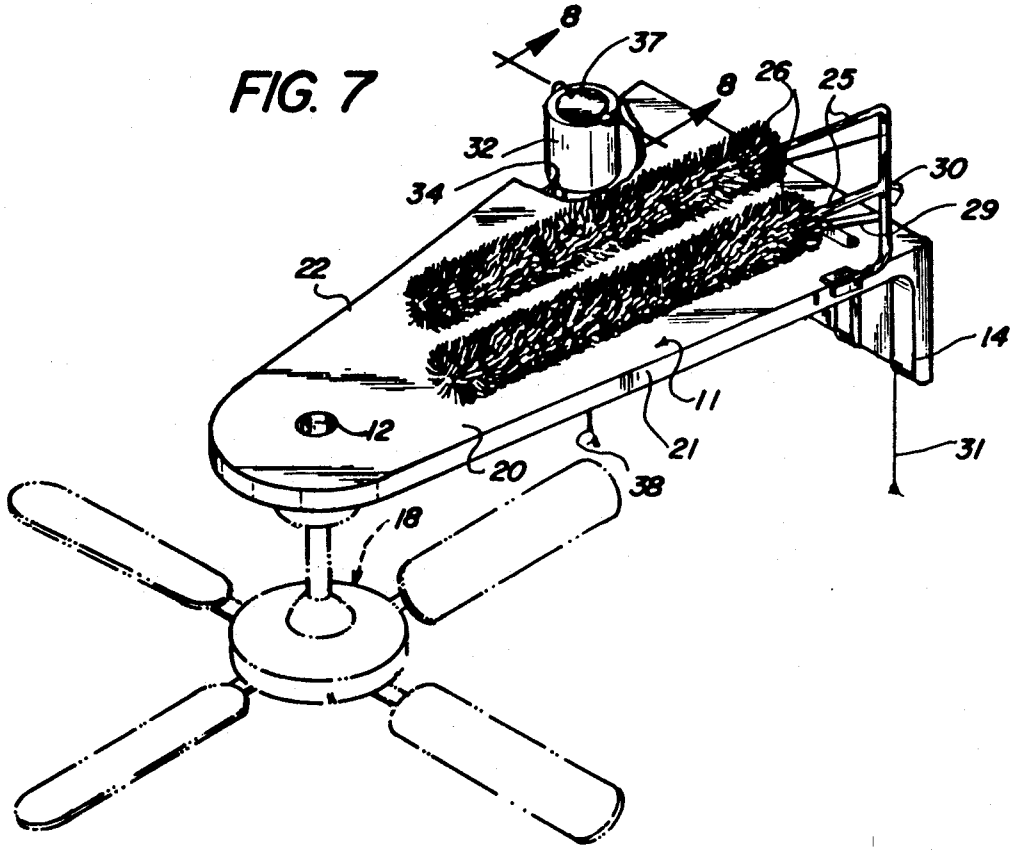
FIG. 7 is an isometric illustration of a further modified aspect of the invention.

The FIG. 7 further illustrates the use of a support container 23 mounted below the top surface 20 fixedly to horizontal mounting plate 11 adjacent the second side 22. The support container 32 includes a support container floor 33 having a floor recess 33*a*. A container outlet port 34 is directed through the support container for purposes to be described in more detail below. The container includes a container cavity 35, with a lid 36 having a lid hinge 37 mounted above the container, with the lid 36 further including a lid actuator cord 38 mounted to a top surface of the lid. A pressurized container 39 typically an air scent therewithin includes a pressurized container nozzle 40 positioned within the floor recess 33*a*, with a nozzle 40 coaxially aligned with the outlet port 34. Upon manual tensioning of the lid actuator cord 38, the lid 36 is directed against the inverted pressurized container 39 to effect depressing of the nozzle 40 to effect a spray distribution through the outlet port 30, whereupon the fan blades of the associated fan assembly effect an enhanced distribution of the scent throughout a room environment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A fan mounting bracket apparatus, comprising, a horizontal mounting plate, with the horizontal mounting plate including a plate rear edge, and a vertical mounting plate orthogonally and integrally mounted to the horizontal mounting plate at the rear edge, and the horizontal mounting plate including a top surface spaced from the bottom surface, the bottom surface including first spaced ribs mounted longitudinally of the horizontal mounting plate, and the vertical mounting plate including second spaced ribs, with the first spaced ribs orthogonally intersecting the second spaced ribs to maintain geometric integrity of the horizontal mounting plate and the vertical mounting plate, and the horizontal mounting plate including a horizontal mounting plate bore directed through the horizontal mounting plate spaced from the rear edge, and a ceiling fan assembly mounted to the horizontal mounting plate bottom surface coaxially aligned to the horizontal mounting plate bore, with the ceiling fan assembly including a plurality of ceiling fan blades rotatably mounted relative to the ceiling fan assembly, and the horizontal mounting plate includes a first side spaced from a second side, wherein the first side and the second side intersect the rear edge, and the horizontal plate top surface includes a support post, the support post includes a post lower leg, the lower leg orthogonally oriented relative to the support post, and the lower leg mounted to a lower distal end of the support post, and a lower leg hinge tube mounted along the horizontal plate second side, with the support post lower leg rotatably mounted within the lower leg hinge tube, and at least one support post top leg orthogonally mounted to the support post parallel to and above the support post lower leg, wherein the support post top leg rotatably mounts a roller brush, and the support post includes an actuator support bar fixedly and orthogonally mounted to the support post above the support post lower leg, wherein the support bar includes an actuator cord, whereupon tensioning of the actuator cord effects pivotment of the support post about the lower leg hinge tube to effect engagement of the roller brush with the fan blades.

2. An apparatus as set forth in claim 1 wherein the support post includes a tension spring mounted between the support post and the horizontal mounting plate top surface.

3. An apparatus as set forth in claim 2 including an abutment bar fixedly mounted to the horizontal mounting plate top surface, with the abutment bar including an abutment bar free end, with the abutment bar free end arranged for engagement with the support post when the support post is in a first raised orientation and wherein the support post is separated from the abutment bar in a second lowered position.

4. An apparatus as set forth in claim 3 including a support container, the support container positioned adjacent to the second side below the horizontal mounting plate bottom surface, the support container including a support container floor spaced below the horizontal mounting plate, the support container floor including a floor recess, and the support container including an outlet port directed through the support container, the support container including a support container cavity, and a support container lid pivotally mounted to the support container above the cavity, the lid including a lid hinge pivotally mounting the lid relative to the support container at an upper distal end of the support container, and an actuator cord mounted to the lid, and a pressurized container positioned within the support container cavity, the pressurized container including a container nozzle, the container nozzle positioned within the floor recess and the container nozzle coaxially aligned with the outlet port, whereupon tensioning of the lid actuator cord effects projection of a discharge from the pressurized container through the outlet port.

* * * * *